United States Patent [19]

Kumagai et al.

[11] 4,386,839

[45] Jun. 7, 1983

[54] ELECTROSTATIC COPYING APPARATUS

[75] Inventors: Junichi Kumagai, Tokyo; Nobutaka Wakao, Kawasaki, both of Japan

[73] Assignee: Tokyo Shibaura Denki Kabushiki Kaisha, Kawasaki, Japan

[21] Appl. No.: 245,974

[22] Filed: Mar. 20, 1981

[30] Foreign Application Priority Data

Mar. 26, 1980 [JP] Japan ..... 55-38652
Mar. 26, 1980 [JP] Japan ..... 55-38669

[51] Int. Cl.[3] ..... G03G 15/00; G03G 21/00
[52] U.S. Cl. ..... 355/3 DR; 29/123
[58] Field of Search ..... 355/3 R, 3 DR; 29/123

[56] References Cited

U.S. PATENT DOCUMENTS 3,490,841 1/1970 Cely et al. ..... 355/3 DR
3,536,397 10/1970 Van Wagner ..... 355/3 DR
4,134,667 1/1979 Schnall et al. ..... 355/3 DR
4,134,669 1/1979 Reitner ..... 355/3 DR
4,231,652 11/1980 Moser et al. ..... 355/3 DR

FOREIGN PATENT DOCUMENTS 54-79044 6/1979 Japan .

*Primary Examiner*—Fred L. Braun
*Attorney, Agent, or Firm*—Cushman, Darby & Cushman

[57] ABSTRACT

A photosensitive drum in an electrostatic copying apparatus includes a drum body and a photosensitive layer provided around the outer peripheral surface of the drum body, a supporting mechanism for rotatably and detachably supporting the photosensitive drum, and peripheral devices which are in contact with the outer peripheral surface of the photosensitive drum at a contact force of 50 g. The drum body is formed of a thin metal tubular body of which the strength per unit length is 2.4 Kg/mm or less, whereby the drum body when it has been removed from the supporting mechanism may be crushed by foot.

9 Claims, 8 Drawing Figures

ELECTROSTATIC COPYING APPARATUS

The present invention relates to an electrostatic copying apparatus with a photosensitive drum and more particularly to an electrostatic copying apparatus of the type in which periphery devices such as a charger, a developing device, a transfer device and a cleaner are disposed in the periphery of the photosensitive drum.

An electrostatic copying apparatus is generally provided with a main body with the photosensitive drum rotatably supported. Disposed around the photosensitive drum are peripheral devices constituting a copying process, such as a charging device, a developing device, a transfer device, a cleaner, and the like. The peripheral devices recently often used are of the type in which those contact with the photosensitive layer of the drum for the purposes of lowering the voltage used, simplification of the structure and ensuring the effects expected.

The photosensitive drum must often be removed from the main body of the copying apparatus for its maintenance or repair. In the removal of the drum, it is desirable to remove the drum from the main body as smooth as possible. To this end, the conventional photosensitive drum 10 is constructed as shown in FIGS. 1 and 2. The photosensitive drum 10 has a tubular main body 12 of which both open ends have flanges 14 press-fitted thereinto and fixed thereto by means of a fixing means 16.

A shaft 18 passes through the flanges 14 to project from the flanges 14 outwardly. Both ends of the shaft 18, projecting outwardly from the flanges 14, are rotatably supported by a pair of drum guides 22 formed on a pair of base plates 20 of the main body of the copying apparatus. The end portions of the shaft 18 removably engage with adjustors 24 provided on the base members 20 thereby to inhibit the axial movement of the shaft 18. In actually removing the photosensitive drum 10 from the main body of the copying machine, the shaft 18 is disengaged from the adjustors 24, and then the shaft 18 is axially pulled out from the photosensitive drum 10.

The photosensitive drum 10 must have such a thickness of the wall as to prevent its deformation when the flanges are press-fitted thereinto. Further, the photosensitive drum 10 is integrally formed the main body 12 with the flanges 14. Accordingly, the weight of the photosensitive drum 10 is considerably heavy. This makes it difficult to carry or mount/remove the photosensitive drum 10. In case where the photosensitive drum must be exchanged with the new one for a reason that the photosensitive drum 10 expires with the lifetime or the surface of the drum 10 is damaged, the flanges press-fitted can not be removed in an easy way in the conventional copying machine. For this reason, the useless drum 10 is conventionally scrapped without repairing it. In this respect, the conventional drum 10 is uneconomical, leading to increase the cost of the copying apparatus.

The peripheral length of the drum 10 is exactly the same as the length of a copying paper with the largest size. Further, one cycle of the copying process is completed for each rotation of the photosensitive drum 10. Therefore, when a large size of the copying paper is used, the diameter of the main body 12 of the photosensitive drum 10 is necessarily large. The larger diameter of the drum 10 requires a thick drum for supporting the main body of the large diameter. This fact hinders the size-reduction of the copying apparatus.

Accordingly, an object of the present invention is to provide a light weight electrostatic copying apparatus which needs a less amount of material to manufacture and has an improved operability by thinning the thickness of the photosensitive drum.

According to an aspect of the present invention, there is provided an electrostatic copying apparatus which comprises a photosensitive drum including a drum body and a photosensitive layer provided around the outer peripheral surface of the drum body, a supporting mechanism for rotatably and detachably supporting the photosensitive drum, and periphery devices which are in contact with the outer peripheral surface of the photosensitive drum at a prescribed contact force, wherein the drum body is formed of a thin metal tubular body of which the strength per unit length is 2.4 Kg/mm or less, whereby the drum body when it has been removed from the supporting mechanism may be crushed by foot.

The present invention will better be understood when carefully reading the following description taken in connection with the accompanying drawings, in which.

Figure 1:
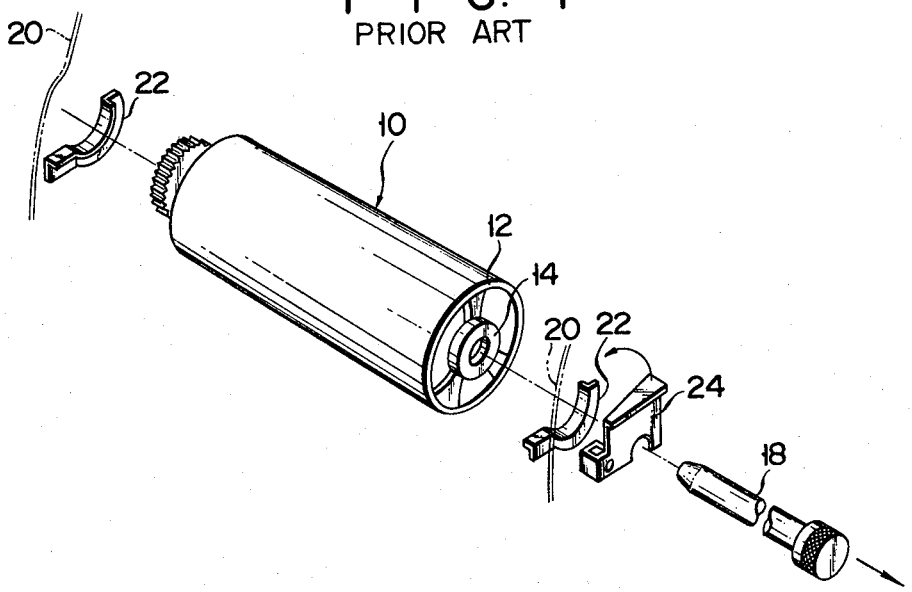
FIG. 1 PRIOR ART
FIGS. 1 and 2 are perspective views of a drum assembly of the prior art.
Figure 2:
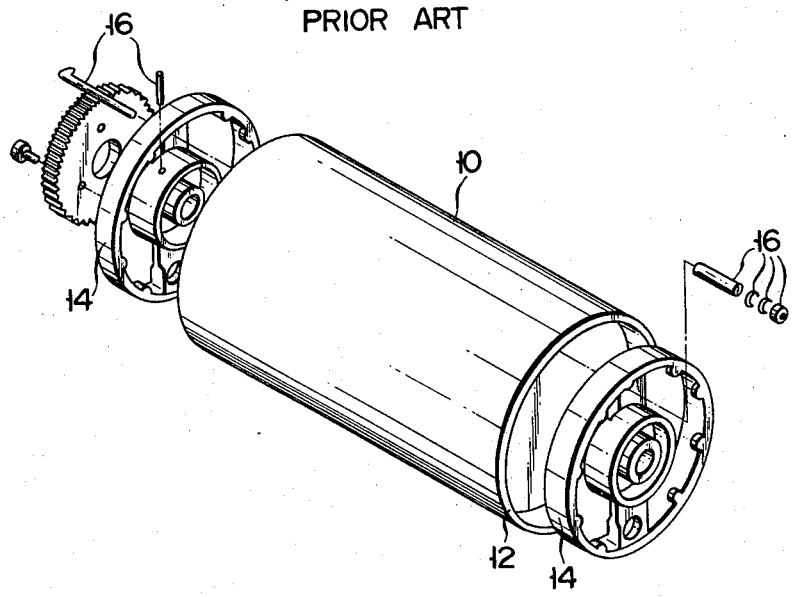
FIG. 2 PRIOR ART
Figure 3:
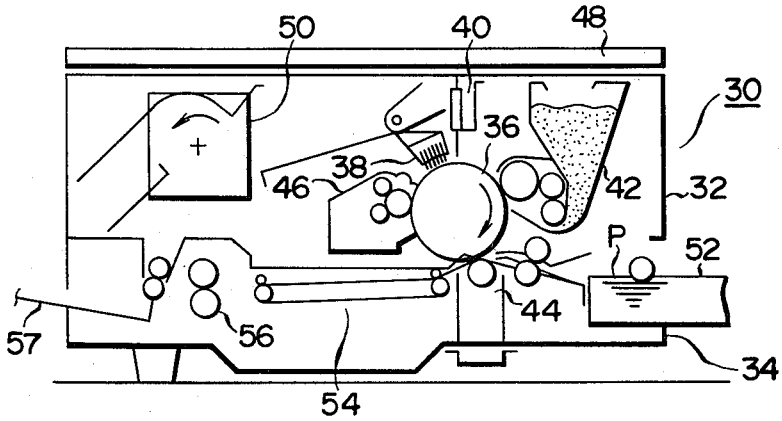
FIG. 3 is a schematic view showing one embodiment of an electrostatic copying apparatus according to the present invention.
Figure 4:
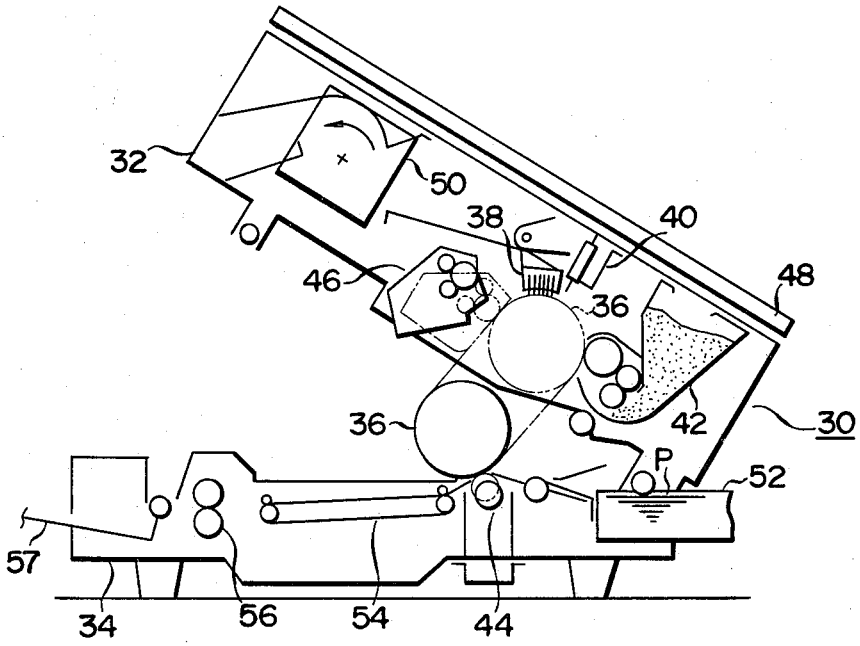
FIG. 4 is a schematic view showing the copying apparatus in which an operation mode is different from that of the apparatus shown in FIG. 3.

One embodiment of an electrostatic copying apparatus according to the present invention will be described referring to FIGS. 3 and 4. In the figures, a main body 30 of a copying apparatus is provided with an upper housing 32 and a lower housing 34 which are rotatably coupled with each other by means of a hinge mechanism (not shown). Disposed at the center and in the upper housing 32 of the main body 30 of the copying apparatus, a photosensitive drum 36 to be described later is clockwise rotatably supported. Disposed around the photosensitive drum 36 along the rotation direction of the drum 36 are successively a charger 38, an exposure 40, a developing device 42, a transfer device 44, and a cleaner 46, which serve as peripheral devices. Of those peripheral devices, only the transfer device is disposed in the lower housing 34, while the remaining ones are all disposed in the upper housing 32. The peripheral devices other than the exposure device 40 all contact at least at their parts with the surface of the photosensitive drum 36 at a given contact force, for example, 50 g, thereby to execute a necessary copying operation. A retreat mechanism (not shown) is coupled with the transfer device 44 and the cleaner 46. The retreat mechanism is so arranged as to retreat both the devices 44 and 46 from the surface of the drum 36 when the lower housing 34 is released by rotating the upper housing 12 upwardly.

A document rest 48 is reciprocately mounted on the upper surface of the upper housing 32. A cooling device 50 is provided at an inner corner of the upper housing 32. A paper feeder 52 for containing a pile of copying papers P is provided on one side of the lower housing 34. A feeding mechanism 54, provided between the paper feeder 52 and the transfer device 44, couples those devices 52 and 44 and feeds sheet by sheet the copying papers from the paper feeder 52 to the transfer device 44. The feeding mechanism 54 extends to the other side of the lower housing 34. A fixing device 56 is provided on the way of the extended transfer mechanism 54. A paper discharging tray 57 is disposed at the end of the feeding mechanism 54, or the other side of the lower housing 34.

Figure 5A:
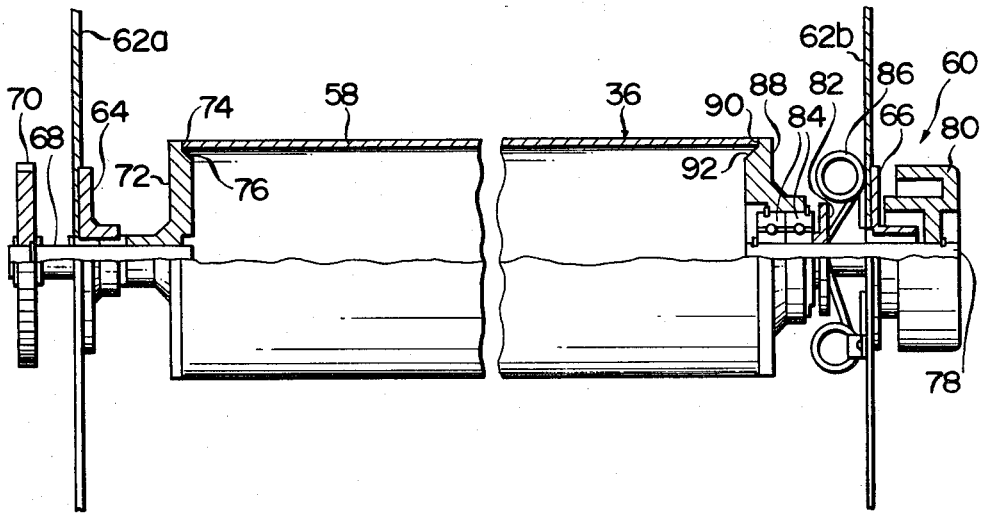
FIG. 5A is a partial cross sectional view of the photosensitive drum and a supporting mechanism for the photosensitive drum.

The photosensitive drum 36 will be described referring to FIGS. 5A and 5B. The photosensitive drum 36 is provided with a main body 58 as a cylindrical metal body with a thin wall. The main body 58 is made of aluminum, having the axial length slightly longer than that length of the copying paper P used with the maximum size, which is normal to the feeding direction of the paper P, and the peripheral length extending along the peripheral direction, i.e. the length developed in the paper feeding direction of the paper, which is shorter than the length of the paper P of the maximum size in the paper feeding direction.

In this embodiment, the copying paper of B4 size (257 mm×364 mm) is the maximum size paper, and the short sides of the paper are along the feeding direction. Accordingly, the diameter of the main body 58 is 80 mm and the axial length is 370 mm in the embodiment. A photosensitive layer of a zinc oxide-resin dispersing system is uniformly layered over the entire surface of the outer peripheral surface of the main body 58. The thickness of the wall of the main body 58 is selected to be within 0.3 to 1 mm. In other words, the strength of the tubular main body 58 per unit length is about 0.17 g/mm (a rate of deformation; 0.125%) to 2.4 Kg/mm (a rate of deformation; 50%).

The photosensitive drum 36 is rotatably and detachably supported by the supporting mechanism 60 provided on the upper housing 32. The supporting mechanism 60 is attached to the upper housing 32, and provided with first and second mounting bases **62*a* and 62*b* oppositely facing each other on the upper housing 32, a plain bearing 64 mounted on the first mounting base 62*a* and supporting a first shaft 68, and a flange receiving portion 66 attached to the second mounting base 62*b* located in opposition to the plain bearing 64. The plain bearing 64 journals the first shaft 68. One end of the first shaft 68 is projected into an inner side of the space defined between the first and second mounting bases 62*a* and 62*b*, while the other end protrudes outwardly from the first mounting base 62*a*. On the other end of the first shaft 68 is fitted a driven gear 70 which is driven by a drive source 9** (not shown).

A first flange portion 72 is fitted coaxially on the one end of the first shaft 68. A first supporting portion for supporting one side of the photosensitive drum 36 is formed on the peripheral portion on the side surface of the first flange portion 72 which faces the second mounting base **62*b*. The first supporting portion includes an annular flat portion 74 with which one side of the drum 26 engages 36 and an annular taper portion 76 of which the diameter linearly reduces from the inner edge of the flat portion 74 toward the second mounting base 62*b*. The diameter of the inner edge of the flat portion 74, i.e. the diameter of the outer edge of the taper portion 76, is equal to the inner diameter of the photosensitive drum 36. The diameter of the outer edge of the flat portion 74 is equal to the outer diameter of the photosensitive drum 36**.

The second shaft 78 is axially slidably fitted to the flange receiving portion 66. One end of the second shaft 78 projects into the inner side of the second mounting base **62*b*, while the other end projects outwardly. A knob 80 is fitted on the other end of the second shaft 78. A discoid spring receiving plate 82 and a pair of bearings 84 are successively fitted to the one end of the second shaft 78. A set spring 86 is interposed between the spring receiving plate 82 and the second mounting base 62*b*. Both ends of the set spring 86 severally abuts on the second mounting base 62*b*, the spring receiving plate 82, and thereby urging the second shaft 78** inwardly.

A second flange portion 88 is fitted on the outer periphery of the bearings 84 so as to block the axial movement of the second flange portion 88. Thus, the second flange portion 88 is rotatable about the second shaft 78 with the aid of the bearing 84. A second supporting portion for supporting the other side of the photosensitive drum 36 is formed on the peripheral edge of that side surface of the second flange portion 88 which faces the first flange portion 72. The second supporting portion has an annular flat portion 90 engaging the other side surface of the photosensitive drum 36 and an annular taper portion 92 of which the diameter is linearly reduced from the inner edge of the flat portion 90 toward the first flange portion 72. The diameter of the inner edge of the flat portion 90, or the outer edge of the taper portion 92, is equal to the inner diameter of the photosensitive drum 36. The diameter of the outer periphery of the flat portion 90 is equal to the outer diameter of the photosensitive drum 36.

The second flange portion 88 is inwardly moved by means of the urging force of the second set spring 86 to hold the photosensitive drum 36 between the flat portions 74 and 90 of the first and second flange portions 72 and 88, and is supported at the taper portions 76 and 92 of the first and second flange portions 72 and 88. The set spring 86 urges the photosensitive drum 36 to engage frictionally the flat portions 74 and 90 and rotates in accordance with the rotation of the driven gear 70.

The operation of the electrostatic copying apparatus thus constructed will be described.

Upon depression of a copying button (not shown), the document table 48 reciprocately moves, while at the same time the drive source drives the driven gear 70 to rotate the photosensitive drum 36. The periphery devices such as the charger 38 execute the given copying operation. As a result, of the well known copying process, the copying paper P has a copied image thereon and is discharged into the tray 15.

The set spring 86 urges the second flange portion 88 against the photosensitive drum 36, so that the photosensitive drum 36 is forcibly pressed against the first flange portion 72, resulting in frictional engagement of them. Under this condition, with the rotation of the first flange portion 72, the photosensitive drum 36 smoothly rotates by its frictional engagement with the first flange portion 72, having no effect upon the contact forces of the periphery devices.

As recalled, the peripheral length of the photosensitive drum 36 is shorter than that length of the copying paper with the maximum size, which extends along the feeding direction. For copying the paper P with the maximum size, a part of the photosensitive layer is used plural times for one copying process. Since the photosensitive layer is continuously formed over the peripheral surface of the main body 58 of the photosensitive drum, however, there arises no problem in the copying process so long as the photosensitive drum 36 rotates at the constant speed.

Figure 5B:
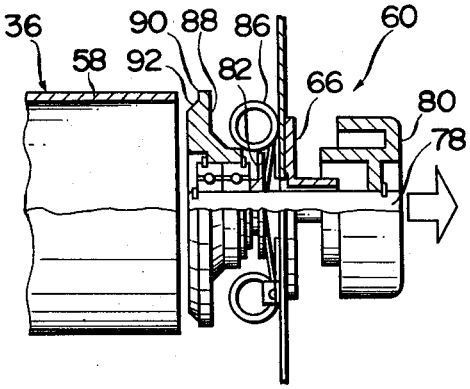
FIG. 5B is a partial cross sectional view of the supporting mechanism in which an operation mode is different from that of the mechanism shown in FIG. 5A.

For the maintenance or the exchange of the photosensitive drum 36, the photosensitive drum 36 is removed from the supporting mechanism 60 in a manner as shown in FIG. 5B. The knob 80 is pulled in a direction of an arrow, resisting against the resilient force of the set spring 86. The end portion of the photosensitive drum 36 is separated from the flat portion 90 of the second flange portion 88 and also from the taper portion 92. As a result, the end portion of the photosensitive drum 36 has a gap with respect to the second flange portion 88. Accordingly, the photosensitive drum 36 may be separated and removed from the first flange portion 72. The retreat mechanism may be provided interlocking with the knob 80. In this case, simultaneously with the pulling of the knob 80, the retreat mechanism operates to retreat the periphery devices from the surface of the photosensitive drum 36. Then, the photosensitive drum 36 is removed from the supporting mechanism 60 and is automatically located at a given location, for example, by a photosensitive drum receiving member (not shown) provided at the lower portion.

In mounting the photosensitive drum 36, one end of the photosensitive drum 36 is made to abut against the first flange portion 72 and then the other end of the drum 36 is held so as to face the second flange portion 88. Under this condition, the knob 80 is released, that is, the pulling force applied to the knob 80 is removed. Then, the set spring 86 is again active to urge the second flange portion 88 against the photosensitive drum 36. Specifically, the taper portion 92 first comes in contact with the end of the photosensitive drum 36 and then the drum 36 is guided along the tapered surface of the taper portion 92. Finally, the inclination of the photosensitive drum 36 is corrected and the end of the photosensitive drum 36 is aligned with the flat portion 90.

The used photosensitive drum 36 is provided at both ends with no parts and is a mere thin tubular body with a strength within 0.17 g/mm to 2.4 Kg/mm. Accordingly, it may be crushed by foot to be flat, thus making it easy to carry the crushed one. This will be described in detail.

Let as calculate a force W (Kg) necessary for crushing the thin tubular member with a thickness h (mm) and a diameter D (mm). An amount ΔD of deformation of such a configuration is expressed by the following equation.

$$\Delta D = 0.149 \times W(D/2)^3/EI$$

where

E: Young's modulus

I: Two-dimensional moment on a cross section Substituting $I = bh^3/12$ (b: the axial length per unit) into the above equation, and arranging the same equation with respect to W/b representing a force per unit length, we have $$W/b = \Delta D h^3 E/0.2235 \times D^3.$$

Assume that the crushing of the drum is equivalent to the drum deformation when it is deformed to have half the diameter, and that the thickness h = 1 mm (the upper limit in the embodiment), D = 80 mm, E = 7,000 Kg/mm$^2$ (aluminum) and ΔD = 40 mm. The force W/b is given $$W/b = 2.4 \text{ Kg/mm}.$$

When the thickness h = 0.3 mm (the lower limit in the embodiment) and the maximum ΔD allowable is 0.1 mm, $$W/b = 0.17 \text{ g/mm}.$$

It is generally said that, when a man treads a thing by foot, it can produce a force three times his weight. When the weight of an average man is 60 Kg and the width of his foot is 70 mm, the treading force he can produce is about 2.6 Kg/mm per unit length.

Accordingly, under this condition, the photosensitive drum 36 in this embodiment can be crushed by foot.

The photosensitive drum 36 may be deformed by the contact force of the periphery devices, as long as the mount of deformation is negligibly small. The periphery devices are in contact with the photosensitive drum 36 at the force of approximately 50 g. Since the axial length of the photosensitive drum 36 is 370 mm, the contact force per unit length of the periphery devices with the photosensitive drum 36 is approximately 0.135 g/mm.

Accordingly, under this condition, the photosensitive drum 36 is not deformed by the contact force by the periphery devices too much to neglect.

As described above, the photosensitive drum 36 may be formed by the thin tubular body 58 with a small diameter and therefore its weight is reduced. The result is that the operability of the copying apparatus is improved, the cost of the manufacturing material is reduced and the size of the copying apparatus is reduced.

Figure 6A:
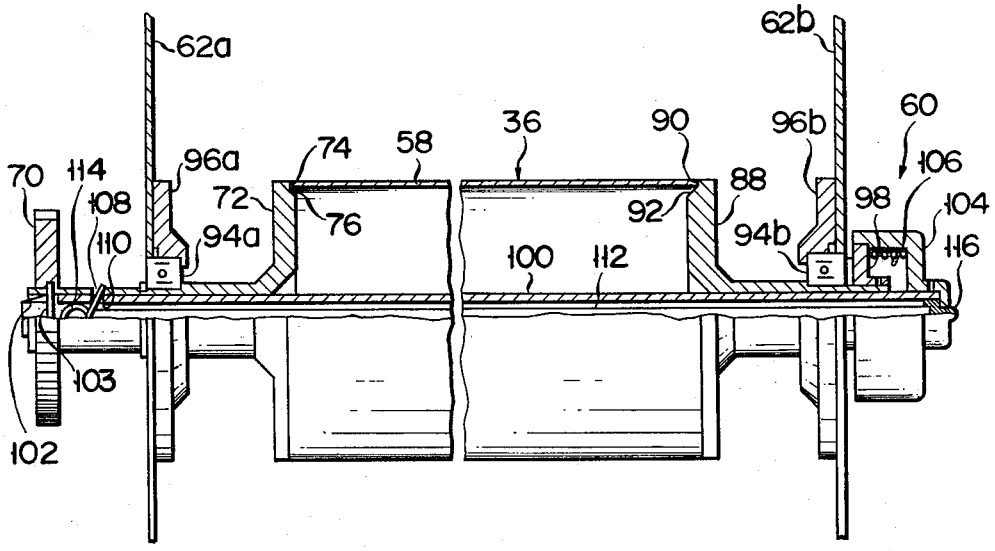
FIG. 6A is a partial cross sectional view of a photosensitive drum and its supporting mechanism used in another embodiment of an electrostatic copying apparatus according to the present invention.
Figure 6B:
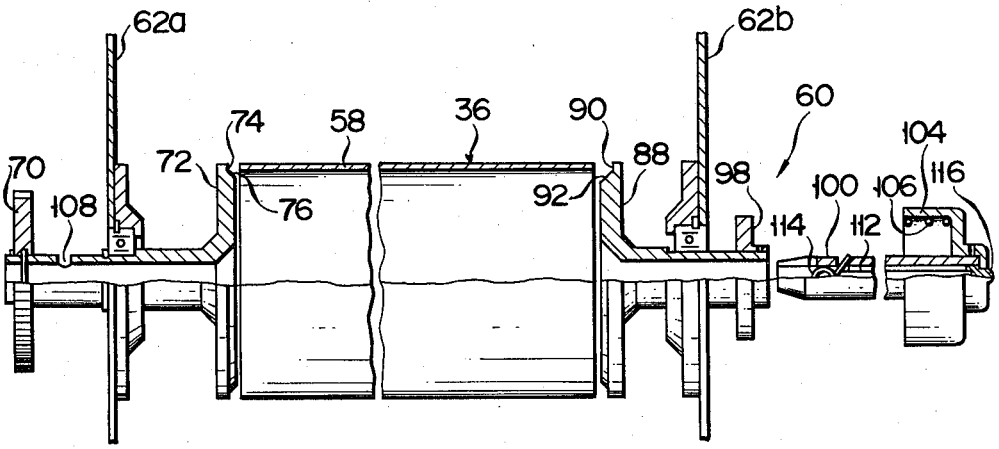
FIG. 6B is a partial cross sectional view of the supporting mechanism in which an operation mode is different from that of the supporting mechanism shown in FIG. 6A.

The present invention is not limited to the above-mentioned embodiment but may variously be changed or modified within the scope of the present invention. For example, the supporting mechanism is not limited to the construction shown in FIGS. 5A and 5B. It may be any construction so long as it can rotatably and detachably support the photosensitive drum 36. For example, the supporting mechanism may be constructed as shown in FIGS. 6A and 6B. Like and same numerals are used to designate like and same portions in the embodiment as mentioned above. As shown, bearing holders 96*a* and 96*b* holding bearings 94*a* and 94*b* are mounted at those portions on the mounting bases 62*a* and 62*b*, respectively, which are located in opposition to each other. The first flange portion 72 fixedly connected at one end with the driven gear 70 is fitted on the bearing 94*a* closer to the mounting base 62*a*. The second flange portion 88 fixedly connected at one end with a flange knob 98 is fitted in the bearing 94*b* closer to the mounting base 62*b*. A tubular shaft 100 is inserted into over the first and second flange portions 72 and 88 which are arranged at a distance in parallel fashion. A cut-away 102 portion is formed at one end of the shaft 100. The cut-away portion 102 is engaged with a pin 103 which is fixing the driven gear 70 and the first flange portion 72 each other for rotating along the peripheral direction with the driven gear 70. Therefore, when the driven gear 70 rotates, the shaft 100 also rotates with the first flange portion 72. The other end of the shaft 100 projects outwardly from the second flange portion 88 and has a shaft knob 104 fitted thereto. The shaft knob 104, while supporting the photosensitive drum 36, slidably contacts the outer peripheral surface of the flange knob 98 in the axial direction and engages the same in the peripheral direction. With this arrangement, the rotation force of the shaft 100 is transferred to the flange knob 98 by way of the shaft knob 104, so that the flange knob 98 and the second flange portion 88 are together rotatable. A compression spring 106 intervenes between the flange knob 98 and the shaft knob 104. The compression spring 106 exerts its repercussive force on the flange knob 98 and the shaft knob 104. The first flange portion 72 and the shaft 100 have a trough-hole 110 and an engaging hole 108 between the mounting base **62*a* and the driven gear 70 respectively. A rod 112, inserted into the shaft 100, engages at one end a lock spring 114 inserted in and located at one end of the shaft 100. One end of the lock spring 114 is inserted into the holes 110 and 108. Therefore, the first flange portion 72 and the shaft 100 axially move in a unit body through the lock spring 114. A push button 116 is attached to the end of the rod 112 and extending outwardly from the shaft knob 104**.

Accordingly, the resilient repercussive force of the spring 106 is exerted on the shaft knob 104 and the flange knob 98 in opposite directions. The force applied to the shaft knob 104 acts to press the photosensitive drum 36 against the first flange portion 72, through the second flange portion 88. The force applied to the flange knob 98 urges the shaft 100 integral with the knob 98 to slide in the same direction as that of the applied force. The shaft 100 engages at the one end of the first flange portion 72 through the lock spring 114. Accordingly, the first flange portion 72 is energized in the same direction to press the photosensitive drum 36 against the second flange portion 88. In this way, the photosensitive drum 36 is reliably supported between the first flange portion 72 and the second flange portion 88.

In the maintenance of the photosensitive drum 36 or an exchange with a new one, a mere push of the push button 116 may remove the photosensitive drum 36 from the supporting mechanism 60. As a result of the pushing, the rod 112 slides to push the lock spring 114, so that the end of the lock spring 114 is taken off from the engaging hole 108. Accordingly, the first flange portion 72 is disengaged from the shaft 100. Under this condition, if the shaft knob 104 is pulled, the shaft 100 together with the rod 112 is pushed out from the first and second flange portions 72 and 88 and the photosensitive drum 36. Since the energizing force applied to the first and second flange portions 72 and 88 has been removed, those are relatively loosely coupled with both ends of the photosensitive drum 36, to allow it to easily be removed.

With such a construction of the supporting mechanism 60, no useless force is applied to the mounting bases **62*a* and 62*b*, so that the use of a thinner plate for the those bases is allowed. Further, the spring 106 exerts the first and second flange portions 72 and 88 to support the photosensitive drum 36. Thus, the fixing force obtained by the tension of the spring 106** is doubled.

What we claim is:

1. In an electrostatic copying apparatus which comprises a photosensitive drum including a drum body and a photosensitive layer provided around the outer peripheral surface of said drum body, a supporting mechanism for rotatably and detachably supporting said photosensitive drum, and peripheral devices which are in contact with the outer peripheral surface of said photosensitive drum at a prescribed contact force and constituting a copying process, the improvement in which said drum body is formed of a thin metal tubular body of which the strength per unit length is between 0.17 g/mm and 2.4 Kg/mm, and wherein said periphery devices contact the surface of said photosensitive drum at a maximum contact force of 50 g, whereby said drum body is not substantially deformed when contacting with said periphery device and whereby said drum body when it has been removed from said supporting mechanism may be crushed by foot.

2. The electrostatic copying apparatus according to claim 1, further comprises a feeding mechanism for feeding a copying paper in a direction normal to the axial direction of said photosensitive drum, wherein the photosensitive layer is laid on the overall outer peripheral surface of said drum body and the length extending in the peripheral direction of said drum body is shorter than the length of the copying paper with a maximum size used along said feeding direction.

3. The electrostatic copying apparatus according to claim 1 or 2, wherein said drum body is made of aluminum, and the diameter and the wall of thickness of said drum body are respectively 80 mm and 0.3 mm to 1.0 mm.

4. The electrostatic copying apparatus according to claim 3, wherein said supporting mechanism is provided with a pair of flanges which are rotatably and supports both ends of said drum body, and one of said flanges is movable along an axial direction of said photosensitive drum, whereby said photosensitive drum supported by said supporting mechanism is detachable from said supporting mechanism when one of said flanges is moved.

5. The electrostatic copying apparatus according to claim 4, wherein said supporting mechanism is provided with a resilient member for giving said movable flange urging force along a direction to press said flange against said photosensitive drum, whereby said photosensitive drum frictionally engages said flanges to rotate in a unit body.

6. The electrostatic copying apparatus according to claim 5, wherein said supporting mechanism is provided with an operation means which is provided to said movable flange and may be pulled resisting the urging force of said resilient member along the axial direction of said photosensitive drum, whereby said photosensitive drum is removed from said supporting mechanism by pulling said operation means.

7. The electrostatic copying apparatus according to claim 6, further comprises a drive mechanism for providing a rotating force to said photosensitive drum, wherein one of said flange includes a follower member driven by the drive force from said drive mechanism.

8. The electrostatic copying apparatus according to claim 7, wherein said supporting mechanism includes a common shaft for rotatably supporting both said flanges.

9. The electrostatic copying apparatus according to claim 7, wherein said supporting mechanism includes individual shafts for rotatably supporting both said flanges.

* * * * *